US006004035A

United States Patent [19]

Hafer et al.

[11] Patent Number: 6,004,035

[45] **Date of Patent: *Dec. 21, 1999**

[54] FLEXIBLE BULK CONTAINER WITH SUPPORTING SIDE BEAMS

[76] Inventors: Harold Franklin Hafer, 26572 Morena Dr., Mission Viejo, Calif. 92691; Peter Roman Apostoluk, 131 E. Frenchman's Bend, Monroe, La. 71203

[ * ] Notice: This patent issued on a continued prosecution application filed under 37 CFR 1.53(d), and is subject to the twenty year patent term provisions of 35 U.S.C. 154(a)(2).

[21] Appl. No.: 08/596,646

[22] Filed: Feb. 5, 1996

[51] Int. Cl.[6] ..... B65D 33/02

[52] U.S. Cl. ..... 383/119; 383/903; 220/9.1

[58] Field of Search ..... 383/119, 104, 383/121.1, 903; 220/9.1, 9.2, 9.3

[56] References Cited

U.S. PATENT DOCUMENTS

| | | | |
|---|---|---|---|
| 2,378,159 | 6/1945 | Royer | 220/9.1 X |
| 2,378,161 | 6/1945 | Sawyer . | |
| 3,105,617 | 10/1963 | Felldin | 383/67 X |
| 3,543,991 | 12/1970 | George . | |
| 3,715,072 | 2/1973 | Muskopf . | |
| 4,019,635 | 4/1977 | Boots . | |
| 4,115,909 | 9/1978 | Corella . | |
| 4,194,652 | 3/1980 | Williamson . | |
| 4,356,933 | 11/1982 | Connolly . | |
| 4,366,905 | 1/1983 | Forshee . | |
| 4,834,255 | 5/1989 | Boots . | |
| 4,840,282 | 6/1989 | Gerhard . | |
| 4,854,462 | 8/1989 | Gerhard . | |
| 4,901,885 | 2/1990 | Boots . | |
| 4,903,859 | 2/1990 | Derby . | |
| 4,927,037 | 5/1990 | Boots . | |
| 5,025,925 | 6/1991 | Wiklund . | |
| 5,052,579 | 10/1991 | Boots . | |
| 5,071,025 | 12/1991 | Boots . | |
| 5,282,544 | 2/1994 | Boots . | |
| 5,289,937 | 3/1994 | Boots . | |
| 5,407,090 | 4/1995 | Boots . | |
| 5,437,384 | 8/1995 | Farrell . | |

FOREIGN PATENT DOCUMENTS

| | | | |
|---|---|---|---|
| 2634469 | 1/1990 | France | 383/119 |
| 8907561 | 8/1989 | WIPO | 383/119 |

*Primary Examiner*—Jes F. Pascua
*Attorney, Agent, or Firm*—Domingue & Waddell, PLC

[57] ABSTRACT

A flexible bulk shipping container having supporting side beams positioned vertically about the side wall panel of the container. The side beams are made of a rigid material and act to distribute lateral bulge forces evenly throughout the container to prevent bulging.

7 Claims, 7 Drawing Sheets

FLEXIBLE BULK CONTAINER WITH SUPPORTING SIDE BEAMS

FIELD OF THE INVENTION

The present invention relates to bulk containers and in particular, flexible bulk containers having supporting vertical side beams which prevent bulging of the container when loaded with flowable materials.

BACKGROUND OF THE INVENTION

To store and transport flowable materials such as grain, chemicals, fertilizers and minerals, intermediate or semi bulk shipping containers have been developed. These containers are often cylindrical in design and are formed from a flexible woven material. Approximately 1,000 to 3,000 lbs. or more of bulk material may be loaded within the containers which customarily have top loading and bottom discharge features. Flexible intermediate bulk containers are easily transported and stored in an exposed condition and can be readily stacked for high density storage or transportation.

U.S. Pat. No. 4,194,652 describes a flexible intermediate bulk shipping container. A woven container is provided which includes a bottom portion and an upstanding side portion. The side portion is formed from one or more panels sewn together at the vertical edges. The lower edge of the cylindrical side portion is sewn to the periphery of the bottom portion, which includes a discharge spout. A similar spout is situated at the top of the container to facilitate in the loading thereof.

As a result of the inherent properties of flowable or bulk material, a lateral force generated by the bulk material is exerted upon the side wall panels of flexible bulk containers. Flexible circular side walls tend to uniformly distribute the lateral force caused by the bulk material about the containers. However, the lateral force tends to cause a bulging of the container. Bulging is an undesired effect as it distorts the containers causing a loss of storage space when the containers' are stacked together. In the extreme, bulging can cause of rupture of the containers and a spilling of the containers' contents. This is especially undesired when the contents are chemical in composition.

Transportation, be it by truck, train or ship, subjects flexible containers to forces of momentum. Hence, acceleration or deceleration of the transporting vehicle may cause a shifting of the contents of the containers and of the container themselves. To ease some of the problems associated with transportation, flexible intermediate bulk containers have been developed with rigid supporting members.

U.S. Pat. No. 5,025,925 describes a flexible intermediate bulk container flexible container having support pillars associated therewith. The outer surface of the container has vertically placed channels which receive the support pillars. The bottom ends of the support pillars are connected to a wooden pallet. The patent describes that the pillars are useful in reducing strain placed upon the upper end of the forward support pillars and the lower end of the backward support pillars when transport velocity is reduced.

U.S. Pat. No. 4,019,635 describes a tubular cardboard or corrugated board bulk intermediate container which rests within a sleeve that is secured to a bottom pallet. The patent further describes that the relative movement of the container within the sleeve provides for the absorption of a large proportion of the impact energy resulting from transportation of the container.

Because flexible intermediate bulk containers are collapsible, attempts have been undertaken to create self standing side walls to ease in the filling of the container.

U.S. Pat. No. 4,903,859 describes a flexible intermediate bulk container which incorporates rigid panels into the side walls of the container. The patent describes that the rigid panels permit the container to stand alone when filled.

While employing some form of supporting structure, the aforementioned patents do not address or attempt to alleviate the problem of container bulging.

One attempt to overcome the problems associated with bulging involves the placement of flexible containers within a rigid outer cubical frame work structure. Examples of such applications are found in the following patents: U.S. Pat. Nos. 5,437,384; 4,834,255; 4,901,885; 4,927,037; 5,052,579; 5,071,025; 5,282,544; 5,289,937; and 5,407,090. However, this approach is burdensome, expensive and complicated as it requires the construction of an external supporting structure.

It is therefore an object of the present invention to overcome the draw backs associated with bulging of flexible bulk containers under load. This object is achieved through the use of vertical side beams positioned about the side wall panel of the flexible bulk container.

SUMMARY OF THE INVENTION

The object of the present invention is achieved by providing a flexible bulk container having vertically placed rigid side beams positioned about the side wall panel of the container. The side beams are connected at the top and at the bottom of the container in such a manner that the side beams bear the lateral forces of the flowable materials being contained and transfer those forces vertically to the top and bottom of the container as well as horizontally to the side wall panel.

The rigid side beams may be formed in a variety of shapes and may be composed of numerous materials. However, the shape and composition of the rigid side beams should function to transfer force longitudinally with relatively little deflection. A preferred shape for the rigid side beams is a triangular or V shaped profile as the material to strength ratio makes this shape economically feasible. A 45 degree angle at the apex is preferred, with the apex preferably pointing towards the center of the container. A commercially available product known as "angle board" or "edge board" would be suitable for constructing the side beams. It has a V shaped profile and is made of paper fiber or plastic.

The side beams may be held in place by a variety of fastening mechanisms. The use of an adhesive to affix the side beams to the side wall panel of the container may be employed. Additionally, the side wall panel may contain sleeves or pockets which receive the side beams and hold them in position about the side wall panel. Laminating the side beams to the side wall panel is also possible. In an alternative embodiment of the invention in which the container has a rigid top and bottom panel, molded receptacles in the top and bottom panels may be provided to secure the ends of the side beams and position them vertically about the side wall panel.

The spacing and number of side beams is dependent on the characteristics of the flowable material that is to be contained. Ideally, the spacing and number of side beams should result in the container being relatively cubical in appearance with bends in the side wall panel occurring between side beams and at the corners of the container. This is often accomplished by using eight side beams paired into sets of two which are spaced equidistant from the other sets about the side wall panel. The side beams act to transfer the lateral bulge force to the areas in the side wall panel where the bends occur. More importantly, the side beams transfer the lateral bulge force away from the side wall panel to the top of the container. This is accomplished by connecting the top ends of the side beams at or near the top panel of the container.

The flexible bulk container of the present invention can be made inexpensively from standard bulk packaging material. When the container is empty, it is fully collapsible and therefore economical to ship. When the container is filled with flowable materials, it conforms to a relatively cubical shape essentially eliminating the problems associated with a "bulged" container and provides a more efficient bulk shipping and storage container. Additionally, the flexible bulk container of the present invention has improved stacking capabilities when loaded as a result of more evenly distributed forces and the added strength of the side beams.

DETAILED DESCRIPTION OF PREFERRED EMBODIMENTS

Figure 1:
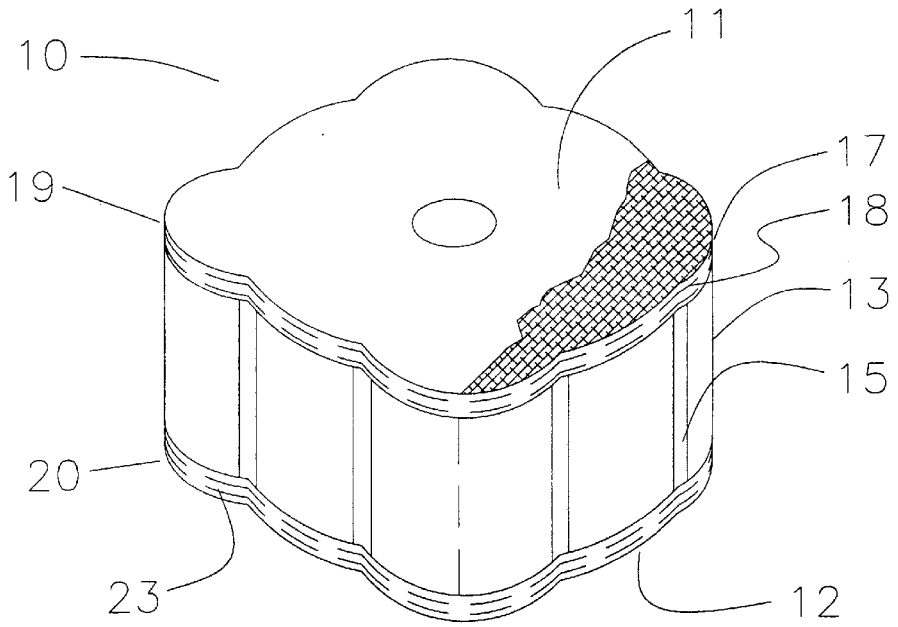
FIG. 1 is an isometric, cut away view of a first embodiment of the flexible bulk container showing side beams positioned with top and bottom sleeves.

With reference to the figures where like elements have been given like numerical designation to facilitate an understanding of the present invention, and particularly with reference to the embodiment of the bulk container of the present invention illustrated in FIG. 1, the bulk container may be constructed of a substantially flexible container 10 having a top panel 11 and a bottom panel 12 interconnected by an upstanding side wall panel 13 defining a collapsible chamber 14 for flowable materials. Preferably, four or more side beams 15 extend in a substantially vertical direction about side wall panel 13 in spaced relation.

Flexible container 10 may be partially formed of a flexible material. As an example, side wall panel 13 may be formed of a flexible material and top panel 11 and/or bottom panel 12 may be formed of a relatively rigid material. Preferably, flexible container 10 is constructed entirely of a flexible material.

The flexible material forming flexible container 10 may be a woven material, and in particular, a woven polypropylene material or a woven polyethylene material. However, it is to be understood that other flexible materials may be utilized in constructing flexible container 10. For example, flexible container 10 may be formed of a paper material or a synthetic material. Examples of synthetic materials may include plastics or rubber.

Flexible container 10 may be formed of multiple layers. For example, flexible container 10 may be composed of a layer of relatively permeable woven material and a layer of relatively impermeable material. The relatively impermeable material may be an external or internal coating. Preferably, the relatively permeable woven material is a woven polypropylene material, and the relatively impermeable material is a synthetic film material. Examples of synthetic film material include nylon, polyethylene, polypropylene, polyvinyl chloride and polyesters.

Figure 2:
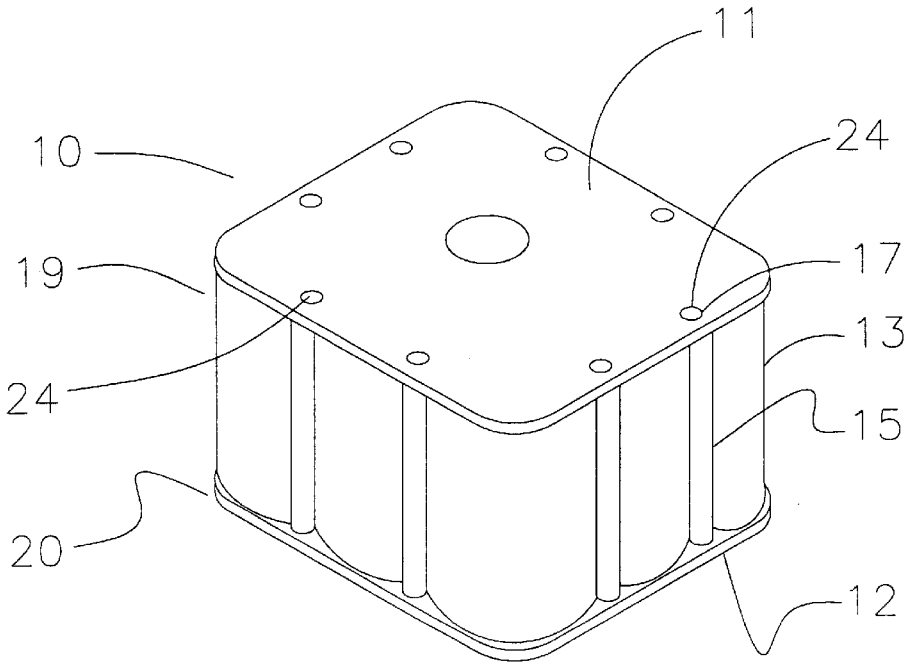
FIG. 2 is an isometric top view of a second embodiment of the flexible bulk container showing a rigid top and bottom panel.

As shown in FIG. 2, top panel 11 and/or bottom panel 12 may be constructed of a substantially rigid material. While it is understood that various materials having rigidity may be utilized to construct top panel 11 and/or bottom panel 12, it is preferred if the rigid material is corrugated paper, wood, plastic or metal.

With reference to FIG. 1, it can be seen that side wall panel 13 may be a formed of a single panel joined together at its ends. Alternatively, side wall panel 13 may be formed of separate side wall panels which are joined together to form side wall panel 13. As an example, side wall panel 13 may be constructed from four separate side wall panels. The separate side wall panels are preferably joined together at their respective ends to adjacent separate side wall panels. It is to be understood that side wall panel 13 may be joined by any fastening procedure. The fastening procedure would depend upon a variety of construction factors, as for example, the type of material utilized to form side wall panel 13. However, in an embodiment in which side wall panel 13 is made of a woven material, it would be preferred if the fastening procedure was accomplished through sewing or stitching.

Again with reference to FIG. 1, it is preferred if the number of side beams 15 is between four and twelve. It is even more preferred if the number of side beams 15 is eight. Side beams 15 may also be in sets of two. When configured in sets of two, it is preferred if the sets of side beams 15 are positioned opposite each other about side wall panel 13.

Figure 3:
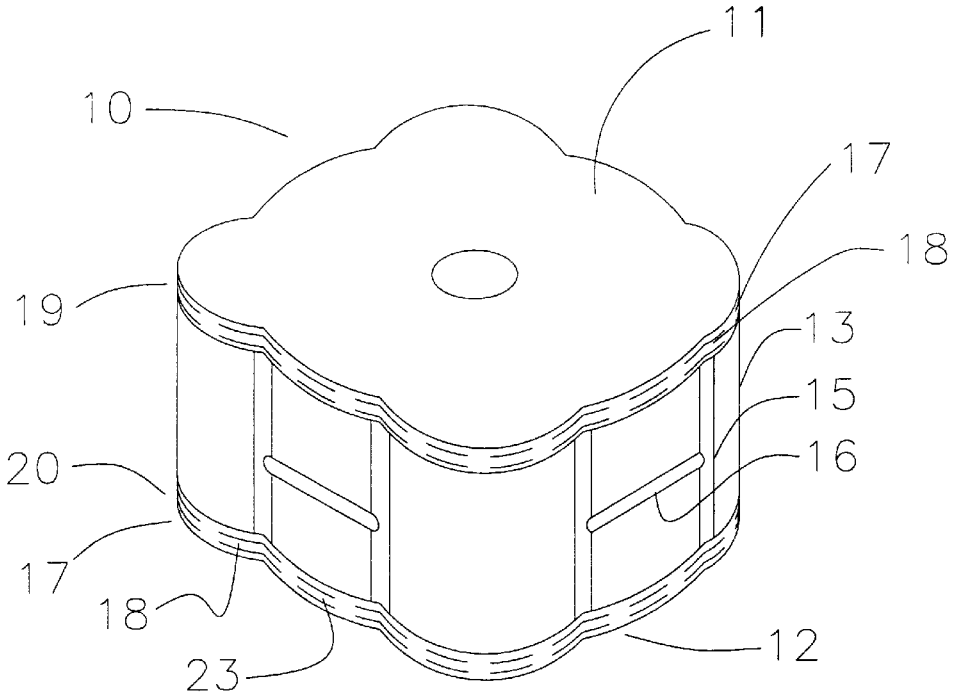
FIG. 3 is an isometric top view of a third embodiment of the flexible bulk container showing an interconnection between sets of side beams.
Figure 4:
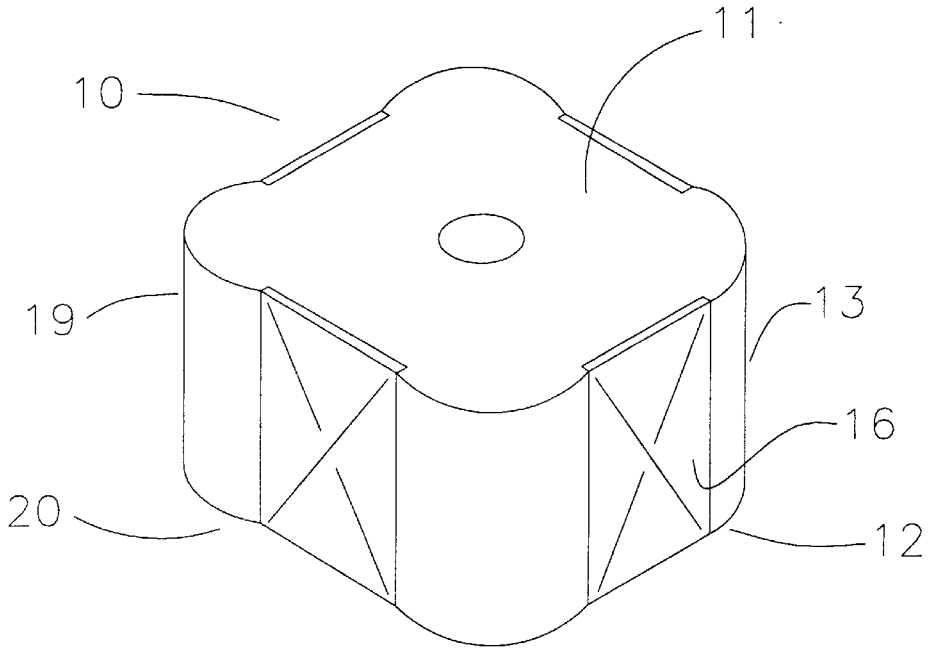
FIG. 4 is an isometric top view of a third embodiment of the flexible bulk container showing the side beams as plates.

As illustrated in FIG. 3, side beams 15 forming the sets of side beams 15 may be interconnected. The sets of side beams 15 may be interconnected with any type of connecting member 16. Connecting member 16 is preferably made of the same material forming side beams 15. Connecting member 16 may be a rod, tube or similar designed device, and its placement between side beams 15 forming the set of side beams may be in any configuration or angle. In a preferred embodiment, connecting member 16 is of a design such that interconnected side beams 15 form a plate, as shown in FIG. 4

FIG. 1 shows side beams 15 extending substantially vertically about side wall panel 13. Preferably, side beams 15 may be positioned at an angle in the range of 10 to 90 degrees in relation to bottom panel 12. More preferably, side beams 15 may be positioned at an angle in the range of 45 to 90 degrees in relation to bottom panel 12. And even more preferably, side beams 15 may be positioned at an angle of about 90 degrees in relation to bottom panel 12.

Again with further reference to FIG. 1, side beams 15 may extend substantially the entire height of said side wall panel 13. To effect distribution of the lateral bulge forces, it is preferable that side beams 15 be formed of a substantially rigid material. The rigid material forming side beams 15 may be any material having rigidity such that the distribution of lateral bulge forces is accomplished. Preferably, such rigid material is corrugated paper, wood, plastic or metal. Side beams 15 may also be designed in a variety of shapes. For example, side beams 15 may be tubular. In addition, side beams 15 may be triangular shaped or V shaped in cross section.

Bulge force is equal in all lateral directions. Hence, without the use of side beams 15 to transfer the bulge force, flexible container 10 would be circular or round. To obtain the desired cubical shaped flexible container 10 which is portrayed in the figures, side beams 15 should be positioned about side wall panel 13 in order to effect an equal diversion of lateral bulge forces. Determining the positioning of side beams 15 may involve the following consideration.

Compute the circumference of a theoretical circle using as a guide (1) the diameter of a loaded circular flexible container without side beams (no restrictions impending the lateral bulge force) and (2) including in the computation the expected elasticity or elongation of the material forming side walls panels of the container. Divide the computed circumference by the number eight (two side beams per side or eight segments which maximizes equal distribution of bulge force). The resulting number is the distance on the circumference of the flexible container 10 that side beams 15 should be positioned apart from each other. However, due to considerations such as product manufacturing tolerances and efficiencies, side beam 15 profiles, side wall panel 13 material selection, content load requirements and others, the positioning of side beams 15 does not need to be located as precisely as described above. In addition, it might be beneficial for reasons other than design (e.g., stacking, handling considerations, side beam construction) to use more than two side beams 15 per side. In this situation, side beams 15 may be positioned symmetrically about side wall panel 13. If a side beam 15 is positioned at the midpoint of a side of side wall panel 13, the positioning of other side beams 15 may be done to balance out the residual bulge force or to more efficiently handle stacking load.

In the embodiment wherein side wall panel 13 has four distinct sides, as for example when formed of four separate (but joined) side wall panels 13, one possible construction of the present invention would be to position four side beams 15 in the center of each separate side wall panel 13. In a preferred embodiment, two side beams 15 are positioned about each of the four side wall panels 13.

Side beams 15 may be positioned about side wall panel 13 in various ways. Side beams 15 may be attached directly to side wall panel 13 or side beams 15 may be directly attached to top panel 11 and bottom panel 12. The attachment means may be dictated by the type of material forming flexible container 10. In the embodiment of the present invention in which side beams 15 are fixedly attached to side wall panel 13, side beams 15 may be attached by adhesive. In the embodiment of the present invention in which side wall panel 13 is made of a flexible metal, side beams 15 may be welded to side wall panel 13. In the embodiment in which side wall panel 13 is made of woven material or paper, a mechanical fastener may be utilized to accomplish attachment. An example of a mechanical fastener is a staple or stitch.

As illustrated in FIG. 1, side beams 15 may be positioned about side wall panel 13 by retaining means 17 which receive and maintain side beams 15 in a substantially vertical position in relation to bottom panel 12. Preferably, retaining means 17 are configured as sleeves 18.

Again with reference to FIG. 1, sleeves 18 may be secured to side wall panel 13. In one embodiment of the present invention, sleeves 18 are positioned at top end 19 of side wall panel 13 and bottom end 20 of side wall panel 13 whereby the ends of side beams 15 may be fixedly attached to side wall panel 13. Sleeves 18 may extend continuously around side wall panel 13 at top end 19 and bottom end 20. However, sleeves 18 may also extend noncontinuously around side wall panel 13 at top end 19 and bottom end 20.

Figure 5:
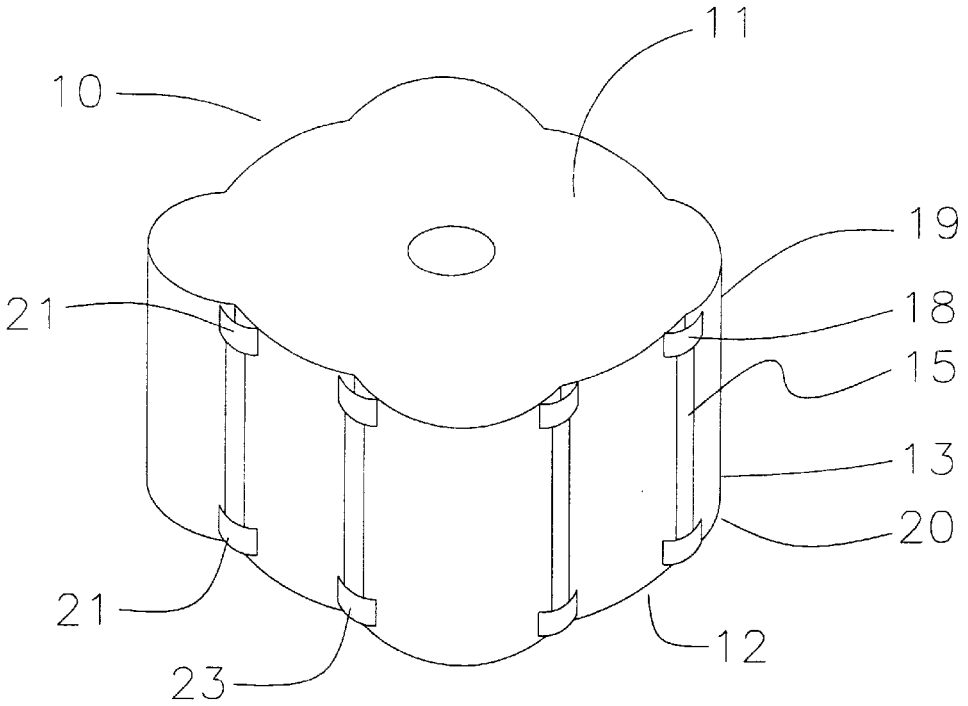
FIG. 5 is an isometric top view of a fourth embodiment of the flexible bulk container showing side beams positioned with top and bottom pockets.

As seen in FIG. 5, sleeves 18 may preferably be in the form of multiple pockets 21 whereby a set of two pockets, one positioned at bottom end 20 and one positioned at top end 19, receive and maintain individual side beams 15 in a substantially vertical position about side wall panel 13. Instead of a set of two pockets, pockets 21 may be a single pocket extending the height of side wall panel 13 which receives one side beam 15.

Figure 6:
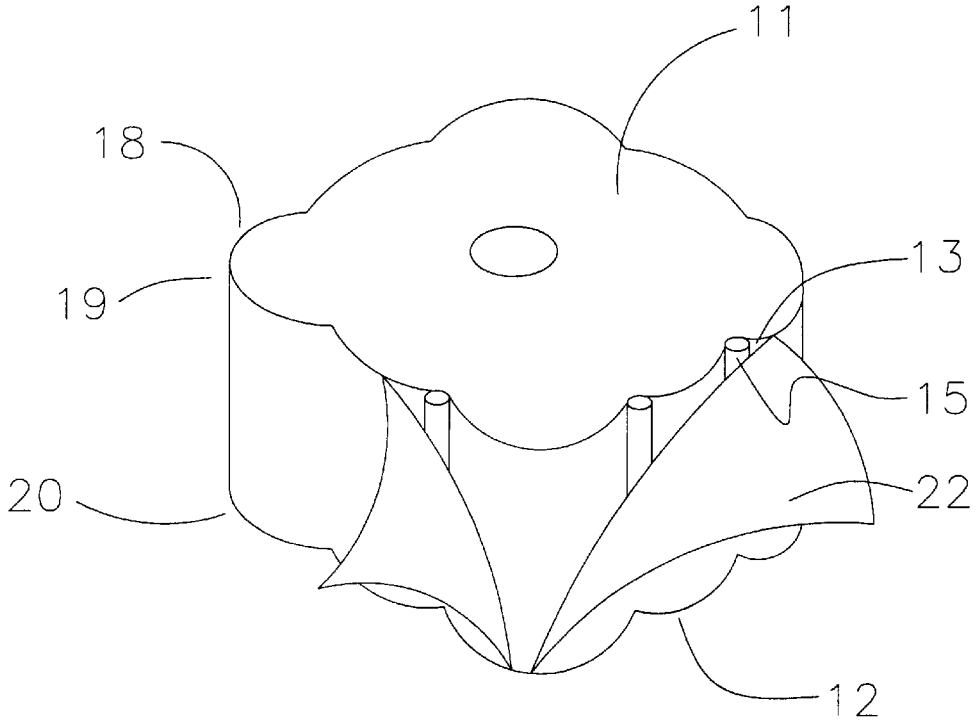
FIG. 6 is an isometric top view of a fifth embodiment of the flexible bulk container showing the side beams positioned with a laminated sheet.

In another preferred embodiment shown in FIG. 6, sleeves 18 may be in the form of sheet 22. Preferably, sheet 22 forms a laminate which substantially covers side wall panel 13 and side beams 15 as they are positioned about side wall panel 13. Sheet 22 may be fastened to side wall panel 13 by various conventional means. Moreover, sheet 22 may extend continuously around side wall panel 13 to form the laminate or sheet 22 may extend noncontinuously around side wall panel 13 to form the laminate. In the latter configuration, sheet 22 may be composed of separate sheets covering portions of side wall panel 13.

Sleeves 18 may be secured to side wall panel 13 by conventional means depending on the material forming sleeves 18. For example, sleeves 18 may be made of a flexible, non-elastic material which is preferably a polypropylene material or a polyethylene material. Sleeves 18 made of a flexible, non-elastic material may be secured to side wall panel 13 by conventional fastening means, as for example, mechanical fastening. For illustrative purposes, the mechanical fastening may be stitching 23 as shown in FIG. 1.

Another preferred embodiment of the present invention is shown in FIG. 2. In this embodiment retainer means 17 attach side beams 15 to top panel 11 and bottom panel 12. Depending on the material used to form top panel 11 and bottom panel 12, various methods may be employed to attach side beams 15. For instance, in a preferred embodiment, top panel 11 and bottom panel are formed of a substantially rigid material. Hence, retainer means 17 may be molded receptacles 24 in top panel 11 and bottom panel 12 which receive respective ends of side beams 15 and maintain side beams 15 in a substantially vertical position about side wall panel 13.

Figure 7:
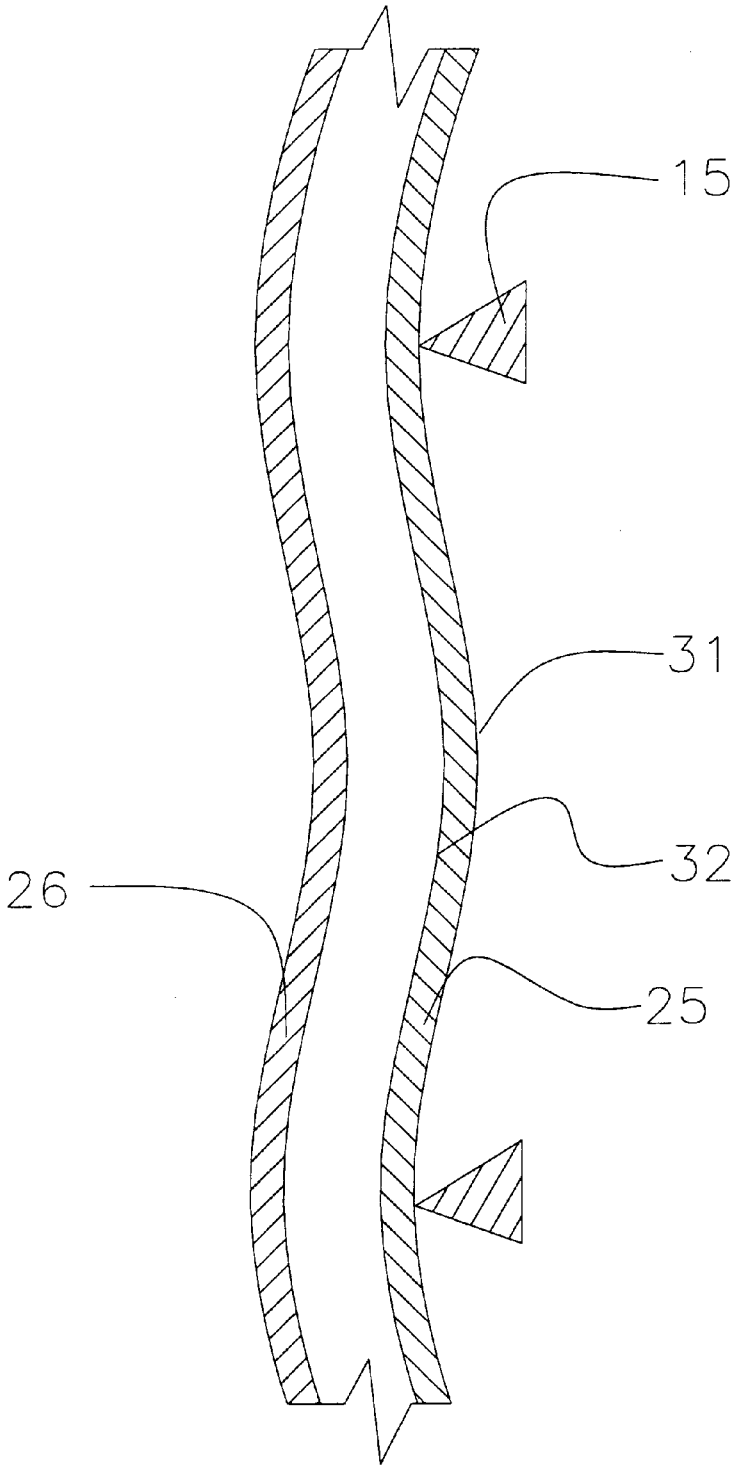
FIG. 7 is a partial cross sectional schematic view of the first embodiment of the flexible bulk container showing side beams positioned on the outer side wall surface of the container.

With reference to FIG. 7, flexible container 10 is shown as having an outer layer 25 of relatively permeable woven material and an inner layer 26 of relatively impermeable material. In this preferred embodiment, side beams 15 may be positioned or attached by retainer means 17 to outer surface 31 of outer layer 25.

Figure 8:
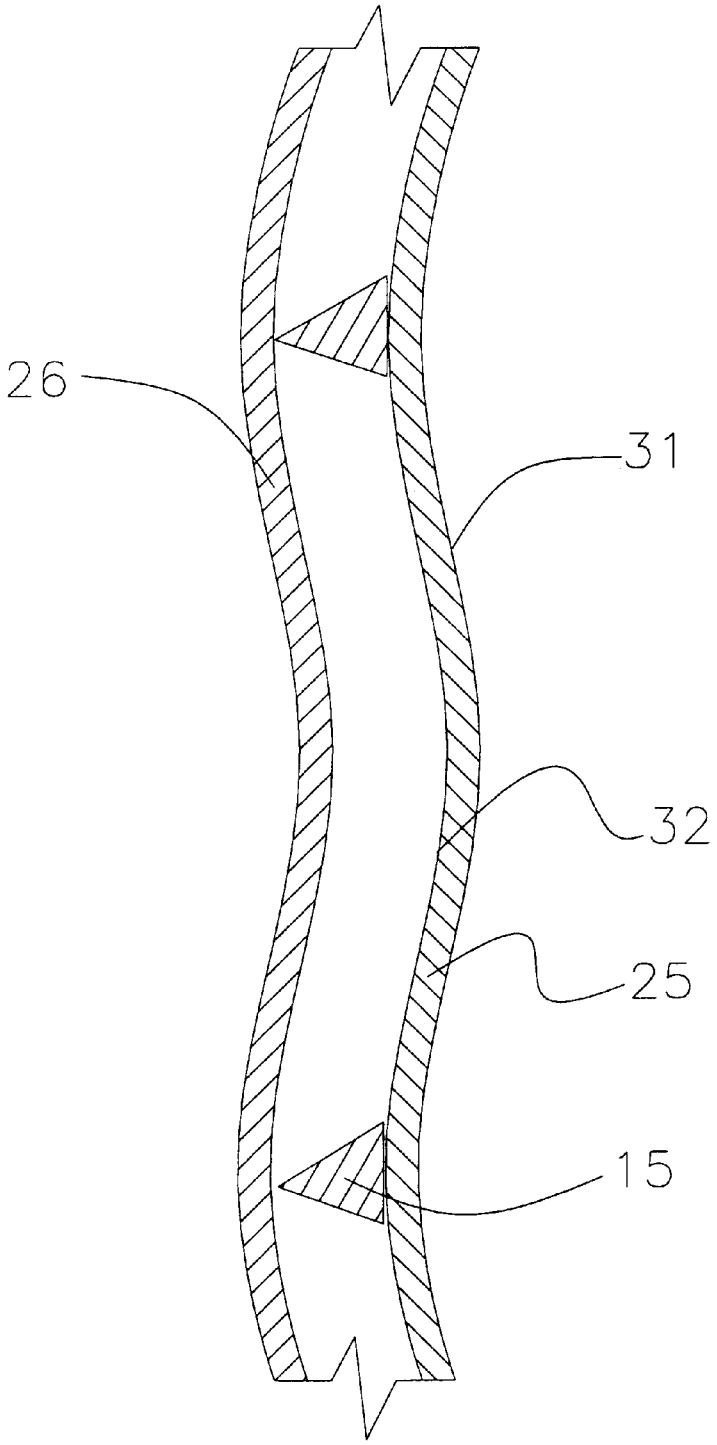
FIG. 8 is a partial cross sectional schematic view of a sixth embodiment of the flexible bulk container showing side beams positioned on the inner side wall surface of the container.

Alternatively and as shown in FIG. 8, side beams 15 may be positioned or attached by retainer means 17 to inner surface 32 of outer layer 25 adjacent to inner layer 26.

Figure 9:
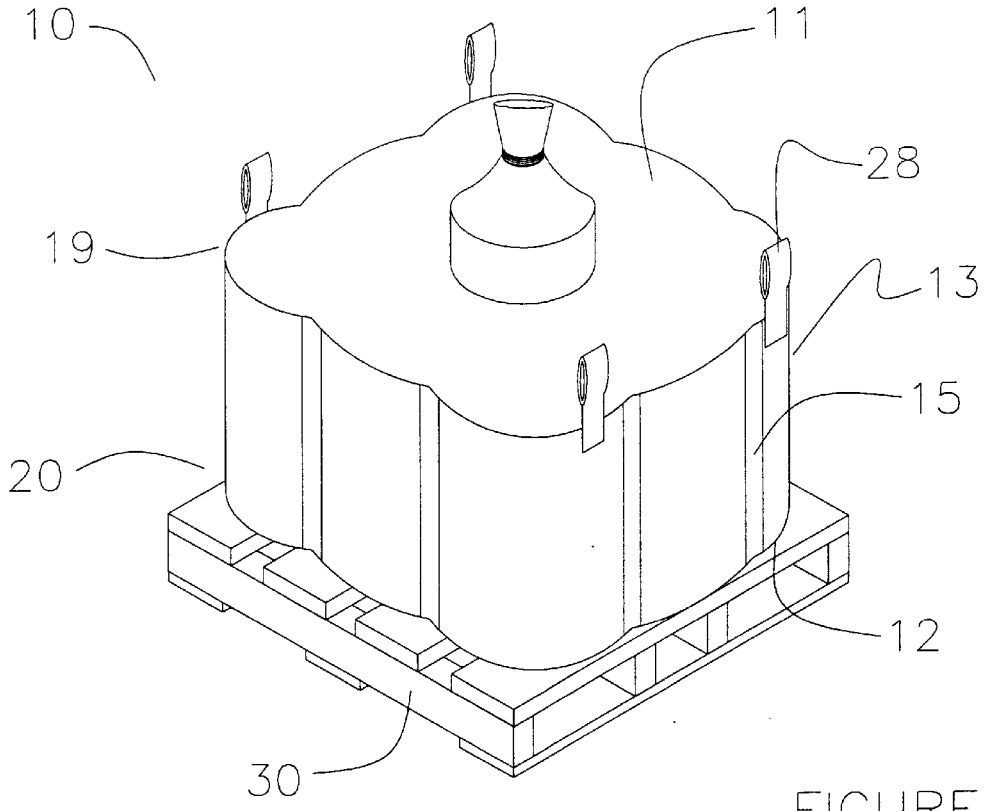
FIG. 9 is an isometric top view of a seventh embodiment of the flexible bulk container showing a top fill opening, lifting loops and a pallet.

As revealed in FIG. 9, flexible container 10 may have a selectively closable fill opening 27 situated in top panel 11 to facilitate the filling of chamber 14 with flowable materials. Flexible container 10 may also have lifting loops 28 for handling or transporting flexible container 10 by forklift. Preferably, lifting loops 28 are fastened to top panel 11 or top end 19 of side wall panel 13. A bottom pallet 30 may also be provided upon which flexible container 10 sits to aid in the transportation of flexible container 10.

Figure 10:
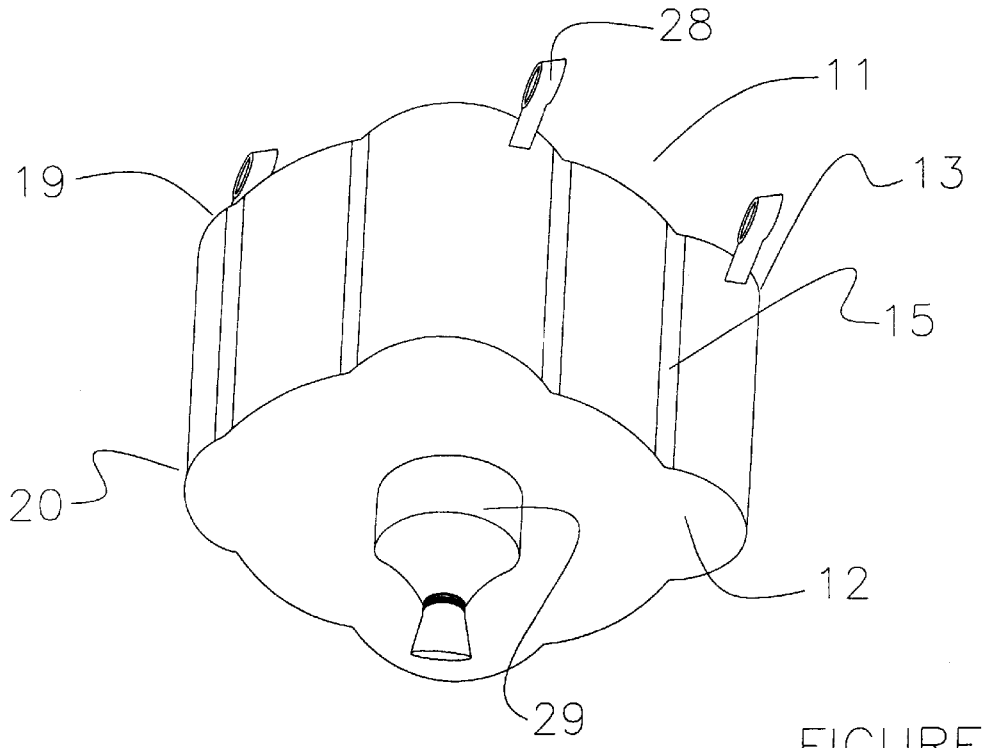
FIG. 10 is an isometric bottom view of the seventh embodiment of the flexible bulk container showing a bottom dispense opening.

As seen in FIG. 10, selectively closable discharge opening 29 may also be situated in bottom panel 12 to facilitate in the removal of the flowable materials contained within chamber 14.

Figure 11:
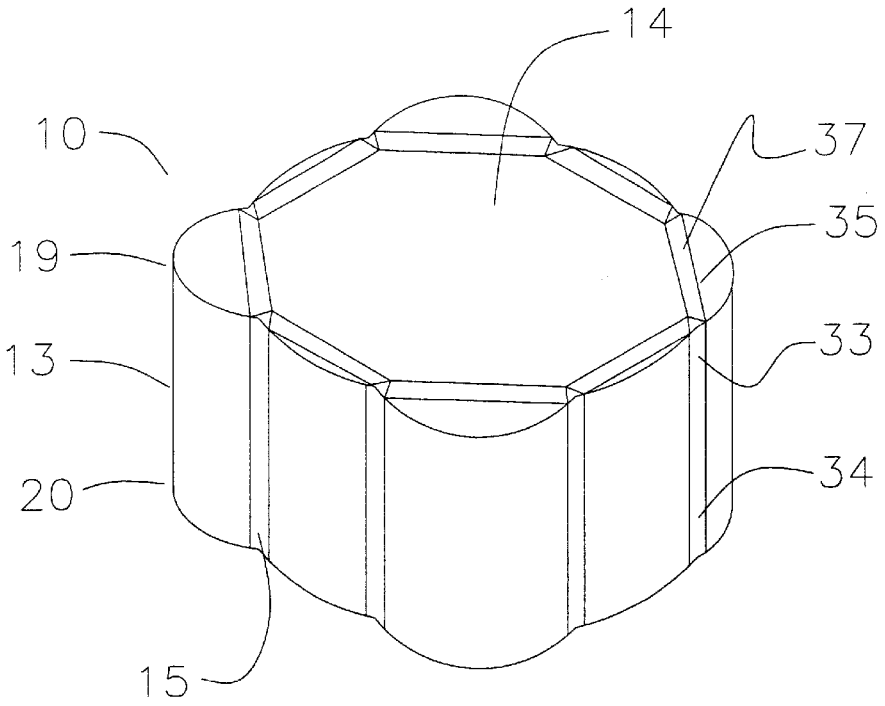
FIG. 11 is an isometric top view of an eighth embodiment of the flexible bulk container showing straps connecting the top ends of the side beams.

In another preferred embodiment depicted in FIG. 11, flexible container 10 is without top panel 11. Instead, top force distribution means 35 interconnect top ends 33 of side beams 15. Top force distribution means 35 function to evenly distribute the lateral forces caused by a load of flowable materials throughout flexible container 10 and specifically to all side beams 15. Preferably, top force distribution means 35 connect adjacent top ends 33 of side beams 15 to each other.

Figure 12:
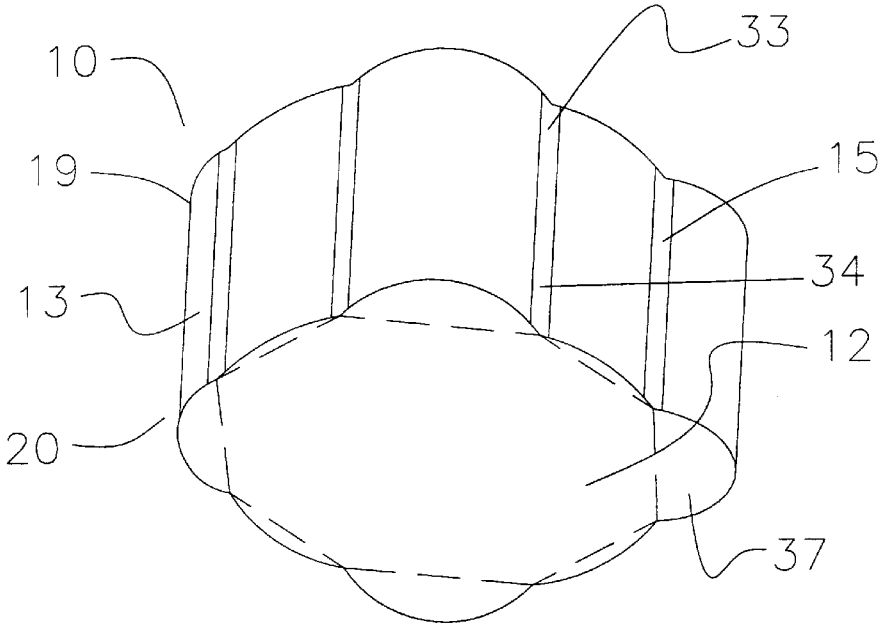
FIG. 12 is a isometric bottom schematic view of the eighth embodiment of the flexible bulk container showing the positioning of straps connecting the bottom ends of the side beams.

As shown in FIG. 12, flexible container 10 may also have bottom force distribution means 36 which interconnect bottom ends 34 of side beams 15. Similarly, bottom force distribution means function to evenly distribute the lateral forces caused by a load of flowable materials throughout flexible container 10 and specifically to all side beams 15. Preferably, bottom force distribution means connect adjacent bottom end 34 of side beams 15.

Top force distribution means 35 and bottom force distribution means 36 may be any device which provides for the interconnection of side beams 15 and function to distribute the lateral force as aforesaid. Examples may include wires and preformed rigid material. Preferably, top and bottom force distribution means 35 and 36 are straps 37 formed of a non elastic material. In the embodiment just described, retainer means 17 may also position or attach side beams 15 to side wall panel 13.

In the embodiment described above, side beams 15 are relatively restricted from moving when chamber 14 is filled with flowable materials. As a result, a force exerted in any direction on one of side beams 15 would be countered by an opposite force caused by the same force on one or more of the other side beams 15. Hence, a stabilized equal distribution of forces results. In other words, any outward bound force exerted on a side beam 15 by a force exerted by the lateral force bulge force on side wall panel 13 is transmitted to top end 33 and bottom end 34 of side beams 15 and then is transmitted through top and/or bottom force distribution means 35, 36 to other side beams 15. Since side beams 15 are equally stressed and held in place, flexible container 10 has a fixed dimensional stability. Preferably, eight side beams are used in this embodiment, and top and bottom force distribution means 35, 36 would resemble an octagon which would connect eight geometrical spaced side beams 15 at the top and bottom of flexible container 10 resulting in a stable condition of resistance against all directional stresses.

The bulk container of the present invention may be constructed by providing top panel 11 and bottom panel 12. Side wall panel 13 made of substantially flexible material is then connected to top panel 11 and bottom panel 12 to create a collapsible chamber 14 for flowable materials. Four or more rigid side beams 15 are positioned about side wall panel 13 in a substantially vertical position whereby side beams 15 provide lateral support for flexible container 10 to prevent bulging thereof when chamber 14 contains flowable materials. Retainer means 17, as previously described, may be utilized to accomplish the positioning of side beams 15 about side wall panel 13. The number of side beams 15 may be between four and twelve. However, eight side beams are preferred. It is also preferred if side beams 15 are provided in sets of two and are then are positioned opposite another set of side beams 15 about side wall panel 13.

The present invention has utility for a variety of flexible or semi-flexible shipping containers. It is foreseen that one application of the present invention will be with flexible intermediate bulk shipping containers. Flexible intermediate bulk shipping containers are commonly made of permeable woven material having an inner liner of impermeable material such as plastic. These containers customarily hold between 1,000 lbs. and 3,000 lbs. or more of material. Preferably, container 10 may hold about 2,000 lbs. of bulk material for a 1 to 1.5 cubic yard quantity.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

What is claimed is:

1. bulk container, comprising:

a substantially flexible container comprising a top and bottom panel interconnected by an upstanding side wall panel defining a collapsible chamber for flowable materials; said flowable materials creating a bulge force acting against said eight side wall panels, and wherein said substantially flexible container is formed of a material comprising a layer of relatively permeable woven material and a layer of relatively impermeable material;

eight substantially rigid side beams extending substantially vertically about said side wall panel said eight side beams being connected to said top and bottom panel;

a first sleeve secured to the tops of said wall panel;

a second, separate sleeve secured to the bottom of said side wall panel, said ends of said eight side beams are fixedly attached to said first sleeve and said second sleeve, respectively, and wherein said first sleeve and said second sleeve receive and maintain said eight side beams in a substantially vertical position in relation to said bottom panel;

and wherein said eight rigid side beams are sets of two and are in a spaced relation about said side wall panel in order to effect a diversion of said lateral bulge force equally in all lateral directions by providing lateral support for said container to prevent bulging thereof when said chamber contains said flowable materials.

2. The bulk container according to claim 1, wherein said relatively permeable woven material is a woven polypropylene material and said impermeable material is a synthetic film material.

3. The bulk container according to claim 1, wherein said first sleeve and said second sleeve extend continuously around said side wall panel at said top and bottom ends.

4. The bulk container according to claim 3, wherein said first sleeve and said second sleeve are made of a flexible, non-elastic material.

5. The bulk container according to claim 4, wherein said flexible, non-elastic material is selected from the group consisting of a polypropylene material and a polyethylene material.

6. The bulk container according to claim 4, wherein said mechanical fastening means is stitching.

7. The bulk container according to claim 3, wherein said first sleeve and said second sleeve are secured to said wall panel by mechanical fastening means.

* * * * *